US005565298A

United States Patent [19]

Suguro et al.

[11] Patent Number: 5,565,298

[45] Date of Patent: Oct. 15, 1996

[54] METHOD OF PRODUCING TONER FOR DEVELOPING LATENT ELECTROSTATIC IMAGES

[75] Inventors: Yoshihiro Suguro, Numazu; Masaki Takatsugi, Fuji; Hiroshi Yamashita; Kenkichi Muto, both of Numazu; Kazumi Ohtaki, Shimizu-machi; Yoshikazu Kaneko, Numazu; Takayuki Hoshina, Fuji, all of Japan

[73] Assignee: Ricoh Company, Ltd., Tokyo, Japan

[21] Appl. No.: 453,578

[22] Filed: May 26, 1995

Related U.S. Application Data

[63] Continuation of Ser. No. 948,453, Sep. 21, 1992, abandoned, which is a continuation of Ser. No. 596,474, Oct. 12, 1990, abandoned.

[30] Foreign Application Priority Data

Oct. 18, 1989 [JP] Japan ..... 1-272198

[51] Int. Cl.$^6$ ..... G03G 5/00

[52] U.S. Cl. ..... 430/137; 430/109; 430/110

[58] Field of Search ..... 430/109, 110, 430/137

[56] References Cited

U.S. PATENT DOCUMENTS

| | | | |
|---|---|---|---|
| 4,357,406 | 11/1982 | Kouchi et al. | 430/137 |
| 4,613,559 | 9/1986 | Ober et al. | 430/137 |
| 4,746,590 | 5/1988 | Kasai et al. | 430/137 |
| 4,762,764 | 8/1988 | Ng et al. | 430/137 |

FOREIGN PATENT DOCUMENTS

| | | |
|---|---|---|
| 0227097 | 7/1987 | European Pat. Off. . |
| 56-154738 | 11/1981 | Japan . |

*Primary Examiner*—S. Rosasco

*Attorney, Agent, or Firm*—Cooper & Dunham LLP

[57] ABSTRACT

A method of producing a toner for developing latent electrostatic images is disclosed, which comprises the steps of dispersing resin particles comprising a resin in an organic solvent in which the resin is not dissolved; dissolving a dye in the organic solvent before or after dispersing the resin particles in the organic solvent to prepare a dispersion in which the resin particles and the dye are contained, thereby dying the resin particles with the dye; and removing the organic solvent from the dispersion, wherein the ratio of the solubility $[D_1]$ of the dye in the organic solvent to the solubility $[D_2]$ of the dye in the resin of the resin particles, $[D_1]/[D_2]$, is not more than 0.5.

7 Claims, No Drawings

METHOD OF PRODUCING TONER FOR DEVELOPING LATENT ELECTROSTATIC IMAGES

This is a continuation of application Ser. No. 948,453, filed Sep. 21, 1992, which is a continuation of application Ser. No. 596,474, filed Oct. 12, 1990 both abandoned.

FIELD OF THE INVENTION

The present invention relates to a method of producing a toner for developing latent electrostatic images in electrophotography, electrostatic recording and electrostatic printing.

DISCUSSION OF THE BACKGROUND

Electrostatic images formed on an electrophotographic photoconductor and an electrostatic recording medium are generally developed by a wet-type development method using a liquid developer or a dry-type development method by using (i) a mono-component type dry developer consisting of a toner comprising a coloring agent such as a dye or pigment and a binder resin in which the coloring agent is dispersed, or with addition of a charge controlling agent thereto when necessary, or (ii) a two-component type dry developer comprising the above-mentioned toner and solid carrier particles. These development methods have their own advantages and disadvantages, but the dry-type development method is more widely employed.

Conventionally, such toners are prepared by kneading a resin component and a coloring agent component at or above a temperature at which these two components are fused, cooling the kneaded mixture, crushing the same by a mechanical or air-impaction crusher, and classifying the crushed particles. However, this method is complicated in the manufacturing steps and the yield of the toner produced is low.

In another conventional method of producing such toners, a coloring agent, a dispersion-stabilizing agent, and a surface active agent are dispersed in an organic solvent solution of a polymerizable monomer, and the polymerizable monomer is subjected to suspension polymerization as proposed in Japanese Patent Publications No. 51-14895 and No. 47-51830. This method has the advantage over other methods that toner particles can be prepared by a single process. However, agents employed, such as dispersion-stabilizing agent and surface active agent, which cause the charging characteristics and preservability of the toner particles to deteriorate, remain on the surface of the toner particles, and those agents are extremely difficult to remove from the toner particles.

In a further conventional method of producing the toner particles, resin particles are immersed in a dye solution and dyed by the solution as proposed in Japanese Laid-Open Patent Applications No. 50-46333, No. 1-103631, No. 56-154738, No. 63-106667 and No. 64-90454. An advantage of this method over other conventional methods is that the number of the production steps is small. However this method has not yet been studied to the extent that it can be confirmed that the method can be used sufficiently in practice.

SUMMARY OF THE INVENTION

Accordingly, an object of the present invention is to provide a method of producing a toner for developing latent electrostatic images, which can be used in practice, by dispersing resin particles in a dye solution and diffusing the dye into the central portion of each resin particle, thereby completely dying the resin particles.

The object of the present invention can be attained by a method of producing the toner comprising the steps of (1) dispersing resin particles comprising a resin in an organic solvent in which the resin is not dissolved; (2) dissolving a dye in the organic solvent before or after dispersing the resin particles in the organic solvent to prepare a dispersion in which the resin particles and the dye are contained, thereby dying the resin particles with the dye; and (3) removing the organic solvent from the dispersion, wherein the ratio of the solubility $[D_1]$ of the dye in the organic solvent to the solubility $[D_2]$ of the dye in the resin of the resin particles, $[D_1]/[D_2]$, is not more than 0.5.

DETAILED DESCRIPTION OF THE PREFERRED EMBODIMENTS

In the present invention, the solubility of the dye in the organic solvent, $[D_1]$, and the solubility of the dye in the resin, $[D_2]$, are the respective maximum solubilities at 25° C. In particular, the solubility of the dye in the resin, $[D_2]$, can be easily determined by microscopic observation of the separation state of the dye from the resin.

In the present invention, it is preferable that the resin particles be smooth in the surface and spherical in shape, more preferably in a complete spherical shape. This is because when the dye penetrates into the resin particles, if the resin particles have sharp edges, such sharp edge portions are dyed more quickly and more densely and exclusively than the other portions of the resin particles.

In order to obtain spherical resin particles with a high yield, it is preferable to prepare spherical resin particles from polymerizable monomers by suspension polymerization method, emulsion polymerization method, or dispersion polymerization method.

Furthermore, it is preferable to use resin particles which are classified in a narrow particle size distribution. More specifically, it is preferable to use resin particles which include resin particles with a particle size distribution in the range of $L\times0.75$ (μm) to $L\times1.25$ (μm) in an amount of 85 wt. % or more of the entire weight of the resin particles. This is because the resin particles with such a narrow particle size distribution provide toner particles which are uniformly dyed, have uniform quantity of electric charge in each toner particle, and can provide high-quality copy images and for which charge control is easy in a development unit.

In practice, it is preferable that L be in the range of 3 to 20 μm.

In the present invention, the particle size distribution was measured by a commercially available Coulter multisizer (made by Coulter Electronics Co., Ltd.).

In order to prepare complete spherical resin particles with the above-mentioned mean diameter and narrow particle size distribution, a dispersion polymerization method, in particular, the dispersion polymerization method disclosed in U.S. Pat. No. 4,885,350, is suitable.

As the resins for preparing the resin particles for use in the present invention, in particular, for preparing toner particles for thermal image fixing, the following conventionally known thermosetting resins can be employed: homopolymers and copolymers of monomers, for example, styrene and styrene derivatives such as parachlorostyrene; vinyl naphthalene; vinyl esters of vinyl chloride, vinyl bromide, vinyl fluoride., vinyl acetate, vinyl propionate, vinyl benzoate, and vinyl butyrate; α-methylene aliphatic monocarboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate; acrylonitrile; methacrylonitrile; acrylamide; vinyl ethers such as vinyl methyl ether, vinyl isobutyl ether, and vinyl ethyl ether; vinylketones such as vinyl methyl ketone, and vinyl hexyl ketone; and N-vinyl compounds such as N-vinyl pyrrole, N-vinylcarbazole, N-vinylindole, and N-vinylpyrrolidone. In addition to the above, mixtures of the above homopolymers and copolymers, non-vinyl type thermoplastic resins such as rosin-modified phenol-formaldehyde resin, oil-modified resin, polyurethane resin, cellulose resin and polyether resin, and mixtures of the non-vinyl type thermoplastic resins and the above-mentioned thermoplastic resins can be employed.

As the resins for preparing the resin particles for use in the present invention, in particular, for preparing toner particles for pressure image fixing, the following resins can be preferably employed: polyolefins (for example, low-molecular weight polyethylene, low-molecular weight. polypropylene, polyethylene oxide), epoxy resin, polyester (acid value: not more than 10), styrene-butadiene copolymer (molar ratio: 5–30:95–70), olefin copolymers (ethylene-acrylic acid copolymer, ethylene-methacrylic acid ester copolymer, ethylene-vinyl chloride copolymer, ethylene-vinyl acetate copolymer, and ionomer resin), polyvinylpyrrolidone, methylvinyl ether-maleic anhydride copolymer, maleic-acid-modified phenolic resin, and phenol-modified terpene resin. Of the above resin, styrene polymers and styrene-acrylic copolymers are more preferable for use in the present invention.

In the present invention, it is necessary that the ratio of the dye solubility $[D_1]$ in the organic solvent to the dye solubility $[D_2]$ in the resin of the resin particles, that is, $[D_1]/[D_2]$, be not more than 0.5. It is preferable that the ratio $[D_1]/[D_2]$ be not more than 0.2. When the ratio exceeds 0.5, the resin is not dyed at all or even if it is dyed, only the surface portion thereof is dyed. The result is that toner particles with sufficiently high color density cannot be obtained.

As the dyes for use in the present invention, any conventional dyes can be employed as long as the above mentioned solubility relationship can be met. In general, water-soluble dyes such as cationic dyes and anionic dyes are not suitable for use in the present invention because the properties thereof are significantly changeable depending upon the ambient conditions and when they are used in the toner, the resistivity of the toner tends to be decreased and therefore the image transfer ratio tends to be decreased. For this reason, vat dye, disperse dye, and oil-soluble dye are preferable for use in the present invention. Of these dyes, oil-soluble dye is most suitable for use in the present invention. As a matter of course, several dyes can be used in combination for obtaining a desired color tone.

The weight ratio of the dye to the resin to be dyed can be selected as desired, depending upon the desired color tone. However, generally it is preferable that the amount of the dye is in the range of 1 to 50 parts by weight to 100 parts by weight of the resin particles to be dyed.

In the present invention, when an alcohol having a relatively high value of solubility parameter (hereinafter referred to as SP value), such as methanol and ethanol, is employed as a solvent for dying and a styrene-acrylic resin having a SP value of 9 is used as the material for the resin particles, for example, the following dyes can be employed:

C.I. Solvent Yellow (6, 9, 17, 31, 35, 100, 102, 103, 105),
C.I. Solvent Orange (2, 7, 13, 14, 66),
C.I. Solvent Red (5, 16, 17, 18, 19, 22, 23, 143, 145, 146, 149, 150, 151, 157, 158),
C.I. Solvent Violet (31, 32, 33, 37),
C.I. Solvent Blue (22, 63, 78, 83–86, 91, 94, 95, 104),
C.I. Solvent Green (24, 25), and
C.I. Solvent Brown (3, 9).

In addition, the following commercially available dyes can be employed:

Aizen Sot dyes such as Yellow-1, 3, 4, Orange-1, 2, 3, Scarlet-1, Red-1, 2, 3, Brown-2, Blue-1, 2, Violet-1, Green-1, 2, 3, and Black-1, 4, 6, 8 (made by Hodogaya Chemical Co., Ltd.); Sudan dyes such as Yellow-140, 150, Orange-220, Red-290, 380, 460, and Blue-670 (made by BASF); Diaresin, Yellow-3G, F, H2G, HG, HC, HL, Orange-HS, G, Red-GG, S, HS, A, K, H5B, Violet-D, Blue-J, G, N, K, P, H3G, 4G, Green-C, and Brown-A (made by Mitsubishi Chemical Industries, Ltd.); Oil Color, Yellow-3G, GG-S, #105, Orange-PS, PR, #201, Scarlet-#308, Red-5B, Brown-GR, #416, Green-BG, #502, Blue-BOS, IIN, and Black-HBB, #803, EE, EX (Orient Chemical Industries, Ltd.); Sumiplast, Blue GP, OR, Red FB, 3B, and Yellow FL7G, GC (made by Sumitomo Chemical Co., Ltd.); Kayaron, Polyester Black EX-SF300, and Blue A-2R of Kayaset Red-B (made by Nippon Kayaku Co., Ltd.).

The applicable dyes are not limited to the above.

As the organic solvents for dying the resin particles with any of the above dyes, it is preferable to employ solvents in which the resin particles are not dissolved, or in which the resin particles slightly swell with the solvents. More specifically it is preferable that the difference between the SP value of the solvents and that of the resin particles be 1.0 or more, more preferably 2.0 or more. For example, it is preferable to employ an alcohol having a high SP value such as methanol, ethanol or propanol, or an organic solvent having a low SP value such as n-hexane or n-propane in combination with styrene-acrylic resin particles.

However, when the difference in the SP value between the organic solvent and the resin particles is too large, the wetting of the resin particles with the solvent is so poor that the resin particles are not appropriately dispersed in the organic solvent. Therefore, it is preferable that the SP value difference be in the range of 2 to 5.

In the present invention, the dying is carried out, for example, by dispersing the resin particles in the above-mentioned organic solvent in which an appropriate dye is dissolved, and stirring the dispersion under the conditions that the temperature of the dispersion is kept between the glass transition temperature of the resin of the resin particles and the temperature of 20° C. below the glass transition temperature of the resin, whereby the penetrating rate of the dye into the resin particles can be increased and sufficiently dyed resin particles can be obtained in about 30 minutes to about 1 hour. For stirring the dispersion of the dye and resin particles, a conventional stirrer such as homomixer or magnetic stirrer can be employed. In the present invention, the glass transition temperature (Tg) was measured in accordance with the procedure described in Japanese Industrial Standards JISK7121 by use of a commercially available apparatus (Trademark "TAS" made by Rigaku Denki Kogyo Co., Ltd.).

Alternatively, the dyed resin particles can be obtained by directly adding the dye to a slurry comprising an organic solvent and polymerized resin particles which are dispersed in the organic solvent, which is obtained, for example, at the completion of a dispersion polymerization process, and stirring the mixture under the above-mentioned conditions.

In any of the above-mentioned processes, when the temperature at which the resin particles and the dye-containing solvent are mixed and stirred is above the glass transition temperature of the resin particles, the resin particles tend to aggregate during the stirring step, while when the temperature more than 20° C. below the glass transition temperature of the resin, the dying rate significantly decreases.

In the above-mentioned processes, a dyed slurry is obtained. Dyed resin particles can be obtained from the slurry by any conventional methods. For example, dyed resin particles are separated from the slurry by filtration and dried at room temperature, or under reduced pressure. Alternatively, dyed resin particles can be obtained by directly drying the slurry under reduced pressure, without filtration.

The thus obtained dyed resin particles are the toner particles of the toner according to the present invention. The thus obtained toner particles do not aggregate and have substantially the same particle size distribution as that of the resin particles prior to the dying process.

In the present invention, in order to improve the triboelectric charging characteristics of the toner particles, charge control agents which are conventionally known in this field can be contained in the toner particles. In the present invention, a charge controlling agent is dissolved together with the dye in the organic solvent before dying the resin particles, and after the dying, the organic solvent is removed, whereby the charge control agent is caused to stay on the surface of the toner particles. In this case, it is only necessary that the charge control agent be present at the surface of the toner particles. Therefore, no strict requirements with the SP value as made for the dye are made for the charge control agent. The only requirement for the charge control agent is that the dye be soluble in the organic solvent.

As another method of containing the charge control agent in the toner particles, a mechanical deposition method can be employed, in which a charge control agent, preferably with a particle size of 1 μm or less, is mechanically fixed to the surface of the toner particles by causing the charge control agent particles to collide with the toner particles with application of mechanical energy thereto, when necessary, under application of thermal energy, whereby the charge control agent is fixed to the surface of the toner particles to such a fixing degree that the charge control agent does not come off the toner particles while in use.

For this mechanical deposition method, for example, a mixing apparatus such as ball mill, V-blender, or Henshel Mixer, is employed for mixing the charge control agent and the toner particles. Mechanical energy is then applied to this mixture, for instance, by rotating the mixture with rotary blades which are rotated at high speed, or by causing the charge control agent particles to collide with the toner particles within a stream of air which flows at high speed, or by causing both particles to collide with a collision plate in such an air stream, whereby the charge control agent is firmly fixed to the surface of the toner particles.

As commercially available apparatus for the above purpose of applying such mechanical energy, for instance, an apparatus named "Mechanofusion" (made by Hosokawa Micron Co., Ltd.), a crushing mill which is modified so as to reduce crushing air pressure as compared with that of an ordinary crushing mill, an apparatus named "Hybridization System" (made by Nara Kikai Seisakusho Co., Ltd.) and an automatic mortar can be employed.

In the present invention, it is preferable that the amount of the charge control agent is 0.1 to 50 parts by weight to 100 parts by weight of the dyed resin particles for appropriately controlling the triboelectric charging characteristics of the toner particles and image fixing performance, although the above ratio can be varied, depending upon the charge quantity required for the toner particles or a development means for use with the toner particles.

Representative examples of a charge control agent for use in the present invention are as follows:

Nigrosine, azine dyes with an alkyl group having 2 to 16 carbon atoms, basic dyes such as C.I. Basic Yellow 2 (C.I. 41000), C.I. Basic Yellow 3, C.I. Basic Red (C.I. 45160), C.I. Basic Red 9 (C.I. 42500), C.I. Basic Violet 1 (C.I.42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 7 (C.I. 52015), C.I. Basic Blue 24 (C.I. 52030), C.I. Basic Blue 25 (C.I. 520251), C.I. Basic Blue 26 (C.I. 4405), C.I. Basic Green (C.I. 42040), C.I. Basic Green 4 (C.I. 42000), Lake pigments of the above basic dyes which are prepared by using a lake formation agent (for example, phosphotungstic acid, phosphomolybdic acid, phosphotungstomolybdic acid, tannic acid, lauric acid, gallic acid, ferricyanic compounds, or ferricyanic compounds), C.I. Solvent Black 3 (C.I. 26150), Hansa Yellow G (C.I. 11680), C.I. Mordlant Black 11, C.I. Pigment Black 1, benzomethyl-hexadecylammonium chloride, decyl-trimethylammonium chloride, dialkyl tin compounds such as dibutyl tin and dioctyl tin compounds, dialkyl tin borate compounds, guanidine derivatives, polyamine resins such as amino-group-containing vinyl polymers and amino-group-containing condensation polymers, metal complex salts of monoazo dyes described in Japanese Patent Publications Nos. 41-20153, 43-27596, 44-6397, and 45-26478, metal complexes such as Zn, Al, Co, Cr and Fe complexes of salicylic acid, dialkyl salicylic acid, naphthoic acid and dicarboxylic acids, and sulfonated copper phthalocyanine pigments.

In the present invention, fluidity improvement agents can be employed, which are used by mixing with the toner particles and causing the agents to adhere to the surface of the toner particles to improve the fluidity of the toner particles. Representative examples of such a fluidity improvement agent are finely-divided particles of titanium oxide, hydrophobic silica, zinc stearate, and magnesium stearate.

Furthermore, when necessary, lubricants such as polyolefin, aliphatic acid esters, metal salts of aliphatic acids, higher alcohols and paraffin waxes can be employed by depositing them on the surface of the toner particles by the same mechanical deposition method as employed in the case where charge control agents are caused to deposit on the surface of the toner particles. When a charge control agent is also deposited on the surface of the toner particles, a lubricant can be deposited on the toner particles either before or after the deposition of the charge control agent, or at the same time.

The features of the present invention will become apparent in the course of the following description of explanatory embodiments, which are given for illustration of the invention and are not intended to be limiting thereof.

EXAMPLE 1

Preparation of Core Resin Particles 320 g of methanol was placed in a 500-ml three-necked flask fitted with a mechanical stirrer and a cooler. 6.4 g of polyvinyl pyrrolidone (average molecular weight of 40,000) was gradually added to the methanol with stirring, so that the polyvinyl pyrrolidone was completely dissolved in the methanol. 25.6 g of styrene, 6.4 g of n-butylmethacrylate and 0.2 g of 2,2'-azobisisobutylonitrile were added to this solution and completely dissolved therein. The thus obtained solution was stirred with a stream of dry argon gas being passed through the flask to displace the air and then allowed to stand for 1 hour.

The above reaction mixture was then heated to a temperature of 60° C.±0.2° C., with stirring at 200 rpm, by holding the flask in a constant temperature water bath kept in the above temperature range, so that a polymerization reaction was initiated. About 15 minutes after the heat elevation, the reaction mixture began to become milky white in color. Thus, the polymerization was continued for 20 hours. At this stage, the reaction mixture was a stable milky white dispersion. An analysis of the reaction mixture by gas chromatography using ethyl benzene as the internal standard indicated that the polymerization degree reached 98%.

The thus obtained dispersion was cooled and centrifuged at 2000 rpm. As a result, polymerized particles were completely precipitated and the supernatant solution was clear. The supernatant solution was removed and 200 g of methanol was added to the precipitated polymerized particles. The mixture was stirred for 1 hour and the polymerized particles were washed with the methanol. The polymerized particles were again centrifuged under the same conditions as mentioned above. Finally the polymerized particles were washed with water and filtered off.

The polymerized particles were dried at room temperature for 24 hours, and then dried under reduced pressure at 50° C. for 24 hours, whereby styrene-n-butylmethacrylate copolymer particles, which are hereinafter referred to as polymer particles A, were obtained in the form of white powder in a yield of 95%.

The thus obtained polymer particles A, serving as core resin particles for toner particles, have a volume mean diameter of 7.0 μm, and the weight ratio of the polymer particles within a particle size distribution of L×(±25%) was 97% of the entire polymer particles. The glass transition temperature (Tg) of the polymer particles A was 65° C.

Preparation of Toner No. 1 of the Present Invention 1 g of Oil Black 803 (made by Orient Chemical Industries, Ltd., $[D_1]/[D_2]=0.04$) was dissolved in 200 ml of methanol. The thus obtained liquid was drawn through a filter to obtain a filtrate.

24 g of the above prepared polymer particles A was added to the filtrate and the mixture was heated with stirring at 50° C. for 1 hour, and then cooled to room temperature, whereby a dispersion of the polymer particles A was obtained.

The polymer particles A then were filtered off, and dried, whereby dyed resin particles were obtained.

100 parts by weight of the dyed resin particles and 1 part by weight of Spilon Black TRH (made by Hodogaya Chemical Co., Ltd.) serving as a charge control agent were mixed in a blender for 5 minutes and the mixture was subjected to a mechanical charge control agent deposition treatment for depositing the charge control agent on the surface of the dyed resin particles, with the mixture being rotated at 7000 rpm for 5 minutes, by an apparatus named "Hybridization NHS-1 (made by Nara Kikai Seisakusho Co., Ltd.), whereby toner No. 1 according to the present invention was prepared.

EXAMPLE 2

The procedure for Example 1 was repeated except that Oil Black 803 employed in Example 1 was replaced by a mixed dye consisting of 0.8 g of Oil Black HBB (made by Orient Chemical Industries, Ltd., $[D_1]/[D_2]=0.11$) and 0.2 g of Oil Orange 201 (made by Orient Chemical Industries, Ltd., $[D_1]/[D_2]=0.06$), whereby toner No. 2 according to the present invention was prepared.

EXAMPLE 3

Preparation of Core Resin Particles 320 g of methanol was placed in a 500-ml three-necked flask fitted with a mechanical stirrer and a cooler. 6.4 g of polyvinyl pyrrolidone (average molecular weight of 40,000) was gradually added to the methanol with stirring, so that the polyvinyl pyrrolidone was completely dissolved in the methanol. 25.6 g of styrene, 6.4 g of n-butylmethacrylate and 0.2 g of 2,2'-azobisisobutylonitrile were added to this solution and completely dissolved therein. The thus obtained solution was stirred with a stream of dry argon gas being passed through the flask to displace the air and then allowed to stand for 1 hour.

The above reaction mixture was then heated to a temperature of 60° C.±0.2° C., with stirring at 200 rpm, by holding the flask in a constant temperature water bath kept in the above temperature range, so that a polymerization reaction was initiated. About 15 minutes after the heat elevation, the reaction mixture began to become milky white in color. Thus, the polymerization was continued for 20 hours. At this stage, the reaction mixture was a stable milky white dispersion. An analysis of the reaction mixture by gas chromatography using ethyl benzene as the internal standard indicated that the polymerization degree reached 98%.

Thus a slurry containing polymerized particles serving as core resin particles was obtained.

Preparation of Toner No. 3 of the Present Invention

To 330 g of the above slurry, 1.3 g of Oil Red 5B (made by Orient Chemical Industries, Ltd., $[D_1]/[D_2]=0.14$) was added, whereby a dispersion of the polymerized particles was obtained. The thus obtained dispersion was stirred at 50° C. for 1 hour and filtered with suction, whereby dyed resin particles were obtained. The thus obtained dyed resin particles were dried at room temperature for 24 hours.

100 parts by weight of the dyed resin particles and 2 parts by weight of zinc 3,5-di-t-butylsalicylate, serving as charge control agent, were mixed in a blender for 5 minutes and the mixture was subjected to a mechanical charge control agent deposition treatment for depositing the charge control agent on the surface of the dyed resin particles, with the mixture being rotated at 7000 rpm for 5 minutes, by the same apparatus named "Hybridization NHS-1 (made by Nara Kikai Seisakusho Co., Ltd.) as employed in Example 1, whereby toner No. 3 according to the present invention was prepared.

EXAMPLE 4

Preparation of Core Resin Particles 320 g of methanol was placed in a 500-ml three-necked flask fitted with a mechanical stirrer and a cooler. 6.4 g of polyvinyl pyrrolidone (average molecular weight of 40,000) was gradually added to the methanol with stirring, so that the polyvinyl pyrrolidone was completely dissolved in the methanol. 24 g of styrene, 1.6 g of n-butylmethacrylate, 2-ethyl-hexylacrylate and 0.2 g of 2,2'-azo-bisisobutylonitrile were added to this solution and completely dissolved therein. The thus obtained solution was stirred with a stream of dry argon gas being passed through the flask to displace the air and then allowed to stand for 1 hour.

The above reaction mixture was then heated to a temperature of 60° C.±0.2° C., with stirring at 200 rpm, by holding the flask in a constant temperature water bath kept in the above temperature range, so that a polymerization reaction was initiated. About 15 minutes after the heat elevation, the reaction mixture began to become milky white in color. Thus, the polymerization was continued for 20 hours. At this stage, the reaction mixture was a stable milky white dispersion. An analysis of the reaction mixture by gas chromatography using ethyl benzene as the internal standard indicated that the polymerization degree reached 98%.

The thus obtained dispersion was cooled and centrifuged at 2000 rpm. As a result, polymerized particles were completely precipitated and the supernatant solution was clear. The supernatant solution was removed and 200 g of methanol was added to the precipitated polymerized particles. The mixture was stirred for 1 hour and the polymerized particles were washed with the methanol. The polymerized particles were again centrifuged under the same conditions as mentioned above. Finally the polymerized particles were washed with water and filtered-off.

The polymerized particles were dried at room temperature for 24 hours, and then dried under reduced pressure at 50° C. for 24 hours, whereby styrene-n-butylmethacrylate-2-ethyl-hexylacrylate copolymer particles, which are hereinafter referred to as polymer particles B, were obtained in the form of white powder in a yield of 95%.

The thus obtained polymer particles B, serving as core resin particles for toner particles, have a volume mean diameter of 7.3 μm, and the weight ratio of the polymer particles within a particle size distribution of L×(+25%) was 95% of the entire polymer particles. The glass transition temperature (Tg) of the polymer particles B was 60° C.

Preparation of Toner No. 4 of the Present Invention 1 g of Oil Blue IIN (made by Orient Chemical Industries, Ltd.), $[D_1]/[D_2]=0.02$, was dissolved in 200 ml of methanol. The thus obtained liquid was filtered to obtain a filtrate.

24 g of the above prepared polymer particles B was added to the filtrate and the mixture was heated with stirring at 50° C. for 1 hour, and then cooled to room temperature, whereby a dispersion of the polymer particles B was obtained.

The polymer particles B then were filtered off, and dried, whereby dyed resin particles were obtained.

100 parts by weight of the dyed resin particles and 3 parts by weight of zinc 3,5-di-t-butylsalicylate serving as a charge control agent were mixed in a blender for 5 minutes and the mixture was subjected to a mechanical charge control agent deposition treatment for depositing the charge control agent on the surface of the dyed resin particles, with the mixture being rotated at 7000 rpm for 5 minutes, by the same apparatus named "Hybridization NHS-1 (made by Nara Kikai Seisakusho Co., Ltd.) as employed in Example 1, whereby toner No. 4 according to the present invention was prepared.

EXAMPLE 5

The procedure for Example 4 was repeated except that Oil Blue IIN employed as the dye and 3,5-di-t-butylsalicylate employed as the charge control agent in Example 4 were respectively replaced by Oil Black 803 (made by Orient Chemical Industries, Ltd., $[D_1]/[D_2]=0.04$) and Nigrosine Base EX, whereby toner No. 5 according to the present invention was prepared.

COMPARATIVE EXAMPLE

The procedure for Example 1 was repeated except that Oil Black 803 (made by Orient Chemical Industries, Ltd., $[D_1]/[D_2]=0.04$) employed as the dye in Example 1 was replaced by Oil Black BS (made by Orient Chemical Industries, Ltd., $[D_1]/[D_2]=0.56$), whereby a comparative toner was prepared.

EXAMPLE 6

1 g of Oil Black HBB (made by Orient Chemical Industries, Ltd., $[D_1]/[D_2]=0.11$) serving as a dye and 1 g of Spilon Black TRH (made by Hodogaya Chemical Co., Ltd.) serving as a charge control agent were dissolved in 200 ml of methanol. The thus obtained solution was filtered to obtain a filtrate.

In this filtrate, 24 g of polymer particles A prepared in Example 1 was dispersed and stirred at 50° C. for 1 hour to dye the polymer particles. This dispersion was then cooled to room temperature and the dyed polymer particles were filtered off and dried, whereby toner No. 6 according to the present invention was prepared.

EXAMPLE 7

The procedure for Example 6 was repeated except that Oil Black HBB (made by Orient Chemical Industries, Ltd., $[D_1]/[D_2]=0.11$) employed as the dye in Example 6 was replaced by a mixed dye consisting of 0.8 g of Oil Black HBB (made by Orient Chemical Industries, Ltd., $[D_1]/[D_2]=0.11$) and 0.2 g of Oil Orange 201 (made by Orient Chemical Industries, Ltd., $[D_1]/[D_2]=0.06$), whereby toner No. 7 according to the present invention was prepared.

EXAMPLE 8

1.3 g of Oil Red 3B (made by Orient Chemical Industries, Ltd., $[D_1]/[D_2]=0.14$) serving as a dye and 1.3 g of Kayacharger N-1 (made by Nippon Kayaku Co., Ltd.) serving as a charge control agent were dissolved in 320 g of the same slurry as employed in Example 3 to obtain a dispersion. This dispersion was stirred at 50° C. for 1 hour. The dyed resin particles in the dispersion were filtered off and dried for 24 hours, whereby toner No. 8 according to the present invention was prepared.

EXAMPLE 9

1 g of Oil Blue IIN (made by Orient Chemical Industries, Ltd., $[D_1]/[D_2]=0.02$) serving as a dye was dissolved in 200 ml of methanol. This solution was filtered to obtain a filtrate.

In this filtrate, 24 g of the same polymer particles B as employed in Example 4 was dispersed and stirred at 50° C. for 1 hour. The dispersion was then cooled to room temperature and the dyed polymer particles in the dispersion were filtered off.

1 g of Kayacharge N-2 (made by Nippon Kayaku Co., Ltd.) serving as a charge control agent was dissolved in 200 ml of methanol to prepare a solution of the charge control agent.

In this solution, the dyed polymer particles were dispersed at 50° for 1 hour and then cooled to room temperature. The dyed polymer particles with the charge control agent being deposited thereon were filtered off and dried, whereby toner No. 9 according to the present invention was obtained.

EXAMPLE 10

The procedure for Example 9 was repeated except that Oil Blue IIN (made by Orient Chemical Industries, Ltd., $[D_1]/[D_2]=0.02$) employed as the dye in Example 9 was replaced by Oil Black 803 (made by Orient Chemical Industries, Ltd., $[D_1]/[D_2]=0.04$) and 1 g of Kayacharger N-2 employed as the charge control agent in Example 9 was replaced by 3 g of Bontron S-34 (made by Orient Chemical Industries, Ltd.), whereby toner No. 10 according to the present invention was prepared.

The thus obtained toners No. 1 to No. 10 according to the present invention and comparative toner were subjected to a charge quantity checking test and a copy making test.

The charge quantity of each toner was measured by mixing each toner with an iron powder carrier and subjecting the mixture to a conventional blow-off test.

The copy making test was carried out by making copies in practice, using a commercially available copy machine (Trademark "FT-5510" made by Ricoh Company, Ltd.) for the negative toner, and using a commercially available copy machine (Trademark "FT-4820" made by Ricoh Company, Ltd.) for the positive toners.

The results are shown in the following Table:

TABLE

| | Charge Quantity (μC/g) | Color | Image Density |
|---|---|---|---|
| Example 1 | −25.0 | Clear Black | 1.32 |
| Example 2 | −21.0 | Clear Black | 1.35 |
| Example 3 | −18.6 | Clear Red | 1.25 |
| Example 4 | −19.5 | Clear Blue | 1.30 |
| Example 5 | +26.0 | Clear Black | 1.30 |
| Example 6 | −21.7 | Clear Bluish Black | 1.31 |
| Example 7 | −23.2 | Clear Black | 1.36 |
| Example 8 | +16.5 | Clear Red | 1.23 |
| Example 9 | +16.1 | Clear Blue | 1.32 |
| Example 10 | −17.5 | Clear Black | 1.30 |
| Comp. Example | −24.2 | Light Violet | 0.72 |

The results shown in the above TABLE indicate that the toners according to the present invention have uniform charge quantity and provide higher image density and clearer images than the comparative toner. This is because the resin particles for the toners are sufficiently dyed due to the particular choice of the resins and dyes as described. Furthermore, the toners according to the present invention are excellent in light transmittance because the dyes are present in the resin particles, in a molecularly dispersed state, so that the toners are suitable for use with the image formation on transparent image supports for use in overhead projectors.

What is claimed is:

1. A method of producing a toner for developing latent electrostatic images by dry-type development comprising the steps of (1) dispersing resin particles comprising a resin in a liquid medium consisting of an organic solvent in which said resin is not dissolved; (2) dissolving a dye in said organic solvent before or after dispersing said resin particles in said organic solvent to prepare a dispersion in which said resin and said dye are contained, thereby dying said resin particles with said dye; and (3) removing said organic solvent from said dispersion, wherein the ratio of the solubility $[D_1]$ of said dye in said organic solvent to the solubility $[D_2]$ of said dye in said resin of said resin particles, $[D_1]/[D_2]$, is not more than 0.5, and wherein said resin particles are in a complete spherical shape and have a volume mean diameter L of 3 to 20 μm, and include resin particles with a particle size distribution in the range of L×0.75 (μm) to L×1.25 (μm), in an amount of 85 wt. % or more of the entire weight of said resin particles.

2. The method of producing a toner for developing latent electrostatic images as claimed in claim 1, further comprising a step of dissolving a charge control agent in said organic solvent before or after said resin particles are dispersed in said organic solvent.

3. The method of producing a toner for developing latent electrostatic images as claimed in claim 1, wherein said resin of said resin particles is selected from the group consisting of styrene resin, acrylic resin and vinyl resin.

4. The method of producing a toner for developing latent electrostatic images as claimed in claim 1, wherein said resin of said resin particles is a copolymer of a styrene or styrene derivative monomer and an acrylic monomer.

5. The method of producing a toner for developing latent electrostatic images as claimed in claim 1, wherein when dying said resin particles with said dye, said dispersion is heated to a temperature between the glass transition temperature of said resin and the temperature of 20° C. below said glass transition temperature.

6. The method of producing a toner for developing latent electrostatic images as claimed in claim 1, further comprising a step of depositing the particles of a charge control agent and/or the particles of a fluidity improvement agent on the surface of said resin particles after the step of removing said organic solvent from said dispersion.

7. The method of producing a toner for developing latent electrostatic images as claimed in claim 6, wherein the particles of said charge control agent and/or the particles of said fluidity improvement agent are firmly deposited on the surface of said resin particles by causing the particles of said charge control agent and/or the particles of said fluidity improvement agent to mechanically collide with said resin particles.

* * * * *